US010895828B2

(12) United States Patent
Portnoy et al.

(10) Patent No.: US 10,895,828 B2
(45) **Date of Patent: *Jan. 19, 2021**

(54) CONTACT CONTROL OF PRINT BLANKET TO IMPRESSION DRUM

(71) Applicant: HP Indigo, B.V., Amstelveen (NL)

(72) Inventors: Vitaly Portnoy, Ness Ziona (IL); Michel Assenheimer, Kfar Sava (IL); Amiran Lavon, Bat Yam (IL); Amir Ofir, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 131 days.

This patent is subject to a terminal disclaimer.

(21) Appl. No.: 16/119,938

(22) Filed: Aug. 31, 2018

(65) Prior Publication Data

US 2018/0373181 A1 Dec. 27, 2018

Related U.S. Application Data

(63) Continuation of application No. 15/320,385, filed as application No. PCT/EP2014/063880 on Jun. 30, 2014, now Pat. No. 10,078,294.

(51) Int. Cl.
*G03G 15/16* (2006.01)

(52) U.S. Cl.
CPC ..... *G03G 15/161* (2013.01); *G03G 15/1605* (2013.01); *G03G 2215/0112* (2013.01)

(58) Field of Classification Search
CPC ..... G03G 15/161
USPC ..... 399/121
See application file for complete search history.

(56) References Cited

U.S. PATENT DOCUMENTS

| | | | | |
|---|---|---|---|---|
| 2,261,913 | A * | 11/1941 | Davidson, Jr. | B41F 33/08 101/218 |
| 3,234,874 | A | 2/1966 | Hornberger et al. | |
| 4,723,145 | A | 2/1988 | Takada et al. | |
| 5,012,735 | A | 5/1991 | Fischer et al. | |
| 5,066,988 | A | 11/1991 | Miyake | |
| 5,272,975 | A | 12/1993 | Dettinger et al. | |
| 5,445,076 | A | 8/1995 | Sugiyama et al. | |
| 5,588,364 | A | 12/1996 | Bolza-Schunemann | |
| 5,649,482 | A * | 7/1997 | Hummel | B41F 13/28 101/218 |
| 5,683,512 | A | 11/1997 | Mailander | |
| 6,308,620 | B1 | 10/2001 | Wadlinger | |
| 8,041,272 | B2 | 10/2011 | Nedelin | |
| 8,068,757 | B2 | 11/2011 | Hashiglichi | |
| 9,616,657 | B2 * | 4/2017 | Rancourt | B41F 33/0063 |

(Continued)

OTHER PUBLICATIONS

Bartolic, et al., "Impact of Printing Additional Inks on Multicolor Reproduction in Liquid Toner Electrophotography", International Conference on Materials, Tribology, Recycling (Research Paper) Jun. 27-29, 2013, 13 pages. http://bib.irb.hr/datoteka/635350.3_Bartolic_Majnaric_Bolanca.pdf.

(Continued)

*Primary Examiner* — Anthony H Nguyen
(74) *Attorney, Agent, or Firm* — HP Inc. Patent Department

(57) ABSTRACT

A printing device includes a print blanket to transfer an ink image onto print media on an impression drum. Responsive to receiving a null cycle trigger during printing, the impression drum is repositioned to a null position to reduce contact between a print blanket and the impression drum.

20 Claims, 4 Drawing Sheets

(56) References Cited

U.S. PATENT DOCUMENTS

| | | | | |
|---|---|---|---|---|
| 2003/0059717 | A1* | 3/2003 | Tabuchi | B41C 1/1075 430/302 |
| 2006/0291875 | A1 | 12/2006 | Ishihara | |
| 2007/0019996 | A1 | 1/2007 | Romem | |
| 2007/0157832 | A1* | 7/2007 | Menu | B41F 13/32 101/218 |
| 2008/0072777 | A1 | 3/2008 | Iwamoto | |
| 2008/0279587 | A1 | 11/2008 | Dehn et al. | |
| 2011/0139023 | A1 | 6/2011 | Malkic et al. | |
| 2011/0158690 | A1* | 6/2011 | Mimbu | G03G 15/167 399/121 |
| 2011/0293307 | A1* | 12/2011 | Ogata | G03G 15/161 399/66 |
| 2013/0333580 | A1 | 12/2013 | Peleg et al. | |
| 2015/0212454 | A1* | 7/2015 | Ichikawa | G03G 15/1605 399/121 |

OTHER PUBLICATIONS

International Preliminaty Report on Patentability dated Jan. 12, 2017, PCT Patent Application No. PCT/EP2014/063880, filed Jun. 30, 2014, The International Bureau of WIPO, 10 pages.

International Search Report and Written Opinion dated Sep. 4, 2014, PCT Patent Application No. PCT/EP2014/063880, filed Jun. 30, 2014, European Patent Office, 12 pages.

* cited by examiner

CONTACT CONTROL OF PRINT BLANKET TO IMPRESSION DRUM

PRIORITY

This application is a Continuation of commonly assigned and co-pending U.S. patent application Ser. No. 15/320,385, filed Dec. 20, 2016, which is a national stage filing under 35 U.S.C. § 371 of PCT Application Number PCT/EP2014/063880, having an international filing date of Jun. 30, 2014, the disclosures of which are hereby incorporated by reference in their entireties.

BACKGROUND

Electro-photography (EP) printing devices form images on print media by placing a uniform electrostatic charge on a photoreceptor and then selectively discharging the photoreceptor in correspondence with the images. The selective discharging forms a latent image on the photoreceptor. Colorant is then developed onto the latent image of the photoreceptor, and the colorant is ultimately transferred to the media to form the image on the media. In dry EP (DEP) printing devices, toner is used as the colorant, and it is received by the media as the media passes below the photoreceptor. The toner is then fixed in place as it passes through heated pressure rollers. In liquid EP (LEP) printing devices, ink is used as the colorant instead of toner. In LEP devices, an ink image developed on the photoreceptor is offset to an image transfer element, where it is heated until the solvent evaporates and the resinous colorants melt. This image layer is then transferred to the surface of the print media being supported on a rotating impression drum.

The transfer of the ink image from the image transfer element to the print media on the impression drum is driven by heat and contact pressure between the image transfer element and the impression drum.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Figure 1:
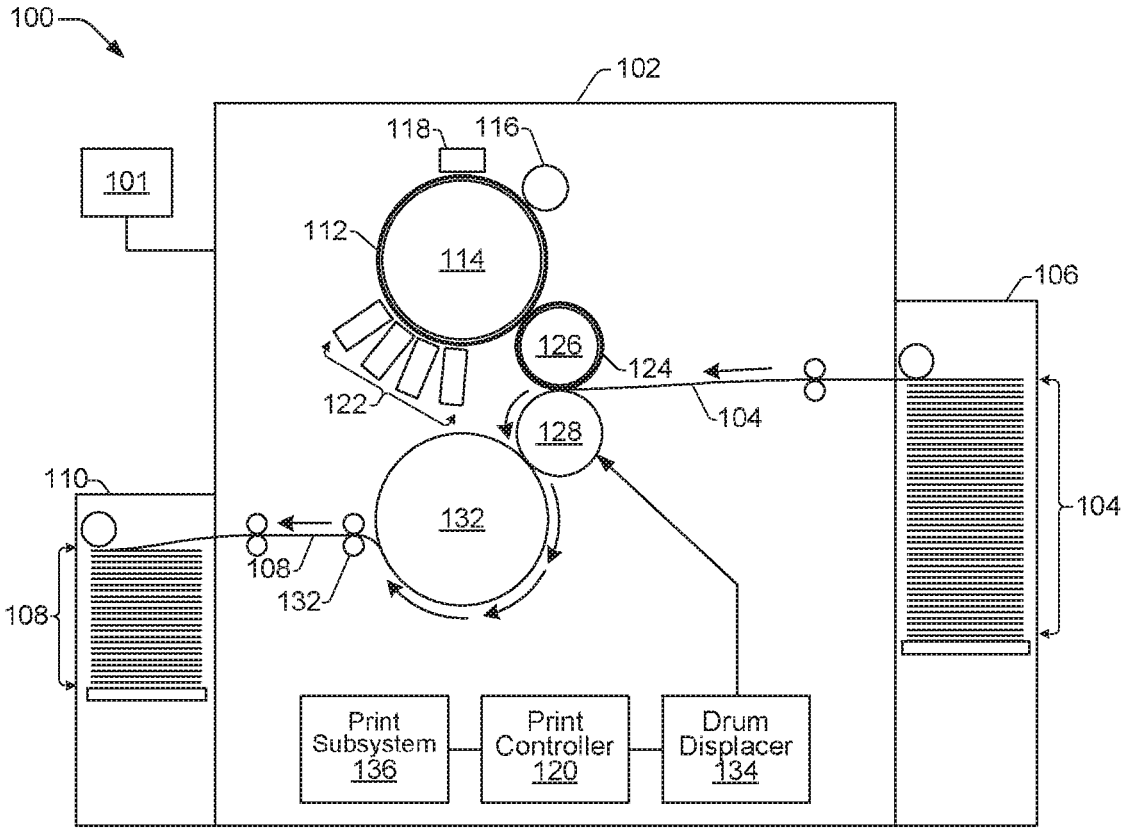
FIG. 1 shows an example of a printing device suitable for detecting the onset of a null cycle and for controlling the pressure and contact between a print blanket and an IMP drum during the null cycle.

The following description provides illustrative examples of an apparatus and printing process associated with an LEP printing process. However, the examples are presented for the purpose of illustration rather than limitation, and they may therefore be applicable to printing processes other than the LEP printing process described below. An LEP printing device implemented as a digital offset press uses electrically charged ink with a thermal offset print blanket. In an LEP printing press, the surface of a photo imaging component is uniformly charged and then selectively discharged to form a latent image. The photo imaging component is often referred to as a "photoconductor" or a "photoreceptor", and it will be referred to as such for the remainder of this description. The latent image is formed on the photoreceptor using photo-induced electric conductivity and a laser beam that discharges the electro-statically charged photoreceptor in a pattern consistent with the image. Charged liquid ink is then applied to the surface of the photoreceptor, forming an ink image. The charged ink is attracted to locations on the photoreceptor where surface charge has been neutralized by the laser, and repelled from locations on the photoreceptor where surface charge has not been neutralized by the laser.

The ink image is then transferred from the surface of the photoreceptor to an intermediate transfer medium (ITM), referred to herein as the "blanket", or "print blanket". The print blanket is wrapped around and attached securely to an ITM drum/cylinder. Transferring the ink image from the photoreceptor to the print blanket is often referred to as the "first transfer". Transfer of the ink image from the photoreceptor to the print blanket in the first transfer is driven by rolling nip contact forces (i.e., between the photoreceptor and the blanket) and electrophoresis of the electrically charged ink particles. The electric field between the photoreceptor and print blanket that drives the ink transfer is created by a bias voltage applied to the print blanket. In addition to having a bias voltage applied to it, the blanket is heated and maintained at a high temperature in order to evaporate solvents present in the liquid ink and to partially melt and blend solid ink particles. The high blanket temperature, along with contact pressure between the blanket and an impression drum, facilitate a "second transfer" of the image onto the print media. In the second transfer, the ink image is transferred from the print blanket to the print media (e.g., sheet paper, web paper) supported on the impression (IMP) drum through heat and contact pressure between the ITM drum and the IMP drum.

Throughout the printing process, the print blanket encounters a number of wear mechanisms that cause damage to the blanket. Damage to the print blanket eventually has a negative impact on the quality of the printed output. Therefore, such wear mechanisms effectively shorten the useful lifespan of the blanket, since printing press operators typically replace print blankets when the print quality begins to suffer. Unfortunately, replacing print blankets is expensive and reduces printer output efficiency because of the time involved in the replacement process.

One common blanket wear mechanism is referred to as blanket memory. Blanket memory can cause damage to a blanket through the continual placement of the same or similar images in the same position on the blanket. If an image is printed many times (i.e., the same or similar image), so that ink is repeatedly applied to the same areas of the blanket while being repeatedly left off of other areas of the blanket, there is increased damage to the blanket in those areas where no ink is being applied. Subsequently, when a different image is printed that calls for the application of ink onto the blanket in areas where ink has not been previously applied, the appearance of the printed image varies between those areas where ink had been previously applied and those areas where ink had not been previously applied.

Another blanket wear mechanism is the repeated pressing of the print media against the print blanket. Mechanical wear of the blanket is caused by the direct interaction of the print media (paper) on the IMP drum with the blanket. Under normal printing conditions, the ITM drum and IMP drum are engaged so as to bring the print blanket and print media into contact. The ITM and IMP drums are compressed together and can have a contact force between them, for example, on the order of 300 to 400 kilograms. The repeated high pressure contact between the blanket and the print media held on the IMP drum can cause the sharp edges of the media to cut into the blanket release layer. Subsequently, when images are printed in areas that extend beyond the cutmarks (e.g., when a larger image is printed), the ink in the cut-mark areas does not transfer well to the print media, and the cut-marks become visible as defects on the printed output.

Furthermore, during a null cycle when normal printing is briefly suspended, these damaging effects on the blanket can be exacerbated. A null cycle is a non-productive cycle that occurs within the printing press due to an interrupt from a printing subsystem. During a null cycle, the writing and development of images to the photoreceptor are suspended, and the transportation of paper may be stopped. Paper may or may not remain on the IMP drum during a null cycle, but the force between the ITM and IMP drums is no longer needed to transfer an image to the paper. Therefore, during a null cycle the force between these drums can continue to cause damage to the print blanket while no images are transferred. In addition, the print blanket is dry because no ink is transferred during null cycles. During a null cycle, the dry print blanket and having no paper on the IMP drum can both increase damage to the blanket caused by direct interaction and pressure between the ITM drum and IMP drum. Damage from this interaction can include, for example, damage to the blanket release layer due to the impression paper, back transfer of dirt from the paper to the blanket, and tearing of the paper.

The press can insert null cycles into the printing process between normal printing cycles based on information it receives from printing subsystems. For example, as an image in a current print cycle is transferred from the blanket to the print media during normal printing, an interrupt can be received from a printing subsystem that causes insertion of a null cycle. An interrupt that triggers a null cycle can be generated by various printing subsystems as a way to inform the print controller within the press that the subsystem is not ready to continue with normal printing. For example, during normal printing, a sensor in the print media transport system may detect that the print media has not arrived at a particular location along the media transport path by a designated instant in time. The detection by the media transport system of such a media timing issue can serve as an interrupt to the print controller within the press that triggers a null cycle. For each subsequent print cycle during which the interrupt from the media transport system persists, an additional null cycle will be inserted to continue suspending the normal printing process. In another example, while performing a color calibration, the printing press can insert null cycles into the printing process while it waits for an inline densitometer/spectrophotometer to measure a printed page before it prints a next page.

During a null cycle, the printing press operates as if normal printing is being performed, but there is actually no image development or image transfer taking place. During the null cycle, most of the printing components remain operational so that when the next print cycle begins, these components are ready to resume writing and transferring images as normal. For example, in a null cycle, the photoreceptor drum, ITM drum, and the image IMP drum will continue to spin. In addition, the contact pressure between the ITM drum and IMP drum can remain high in anticipation of an upcoming printing cycle. However, during the null cycle there is no development of an image onto the photoreceptor and no transfer of an image from the photoreceptor to the blanket on the ITM drum. Thus, the "first transfer" of an ink image from the photoreceptor to the print blanket does not occur during a null cycle. Because there is no transfer of an ink image to the print blanket during the null cycle, the blanket will be dryer during the null cycle than it is during a normal printing cycle because the blanket will be devoid of any ink, ink solvents, or other liquid carrier that typically coat the blanket during a printing cycle. Unfortunately, as noted above, the dry print blanket tends to increase the damage to the blanket caused by the direct interaction and pressure between the ITM drum and IMP drum. As a result, damage to the print blanket is greater during null cycles that during normal printing cycles.

Accordingly, example systems and methods described herein detect the onset of a null cycle and make an adjustment to the contact between a print blanket and an IMP drum. The adjustment in the amount of contact between the print blanket and IMP drum surface reduces the contact from a print level that is used during normal printing, to a null level used during the null cycle when normal printing has been suspended. The null level of contact minimizes or avoids the damaging effects resulting from the interaction of the blanket with the print media (paper) on the IMP drum and from the pressure between the ITM drum and IMP drum. When the print controller in the press detects or receives an interrupt that will trigger a null cycle, the distance between the center axis of the ITM drum and the center axis of the IMP drum is increased. This increase in distance between the drum axes moves the drums away from eachother and reduces the pressure between the drums. The reduced pressure decreases the nip (i.e., the contact area) between the print blanket and the surface of the IMP drum.

In one example, a method of controlling contact between a print blanket and an impression drum includes printing a print job, and during the printing, receiving a null cycle trigger. In response to the null cycle trigger, contact between a print blanket and an impression drum is reduced. In another example, a non-transitory machine-readable storage medium stores instructions that when executed by a processor of a printing device, cause the printing device to detect an interrupt from a printing subsystem during a print cycle of a printing process. In response to detecting the interrupt, contact between a print blanket and an impression drum is reduced from a print level to a null level. In addition, a first null cycle is inserted into the printing process following the print cycle. Thereafter, for each null cycle in which the detection of the interrupt persists, an additional null cycle is inserted into the printing process and the reduced contact between the print blanket and the impression drum is maintained during each null cycle. In another example, a printing device includes a print blanket to transfer an ink image onto print media on an impression (IMP) drum during printing. The printing device further includes a drum displacer to displace the IMP drum, and a controller to receive a null cycle trigger, and in response to the trigger, to cause the drum displacer to move the IMP drum away from the print blanket during the null cycle.

FIG. 1 illustrates an example of a printing device 100 suitable for detecting the onset of a null cycle and for controlling the pressure and contact between a print blanket and an IMP drum during the null cycle. The contact control reduces the amount of contact and pressure between the blanket on the ITM drum and the surface of the IMP drum, which helps to minimize damage to the blanket caused by the pressure and interaction with the print media or impression paper on the impression drum. The printing device 100 comprises a print-on-demand device, implemented as a liquid electro-photography (LEP) printing press 100. An LEP printing press 100 generally includes a user interface 101 that enables the press operator to manage various aspects of printing, such as loading and reviewing print jobs, proofing and color matching print jobs, reviewing the order of the print jobs, and so on. The user interface 101 typically includes a touch-sensitive display screen that allows the operator to interact with information on the screen, make entries on the screen, and generally control the press 100. The user interface 101 may also include other devices such as a key pad, a keyboard, a mouse, and a joystick, for example.

An LEP printing press 100 includes a print engine 102 that receives a print substrate, illustrated as print media 104 (e.g., cut-sheet paper) from a media input mechanism 106. After the printing process is complete, the print engine 102 outputs the printed media 108 to a media output mechanism, such as a media stacker tray 110. The printing process is generally controlled by a print controller 120 to generate the printed media 108 using digital image data that represents words, pages, text, and images that can be created, for example, using electronic layout and/or desktop publishing programs. Digital image data is generally formatted as one or multiple print jobs that are stored and executed on the print controller 120, as further discussed below with reference to FIG. 2.

The print engine 102 includes a photo imaging component, such as a photoreceptor 112 mounted on an imaging drum 114 or imaging cylinder 114. The photoreceptor 112 defines an outer surface of the imaging drum 114 on which images can be formed. A charging component such as charge roller 116 generates electrical charge that flows toward the photoreceptor surface and covers it with a uniform electrostatic charge. The print controller 120 uses digital image print data and other inputs such as print job and print media parameters, temperatures, and so on, to control a laser imaging unit 118 to selectively expose the photoreceptor 112. The laser imaging unit 118 exposes image areas on the photoreceptor 112 by dissipating (neutralizing) the charge in those areas. Exposure of the photoreceptor in this manner creates a 'latent image' in the form of an invisible electrostatic charge pattern that replicates the image to be printed.

After the latent/electrostatic image is formed on the photoreceptor 112, the image is developed by a binary ink development (BID) roller 122 to form an ink image on the outer surface of the photoreceptor 112. Each BID roller 122 develops one ink color of the image, and each developed color corresponds with one image impression. While four BID rollers 122 are shown, indicating a four color process (i.e., a CMYK process), other press implementations may include additional BID rollers 122 corresponding to additional colors. In addition, although not illustrated, print engine 102 also includes an erase mechanism and a cleaning mechanism which are generally incorporated as part of any electrophotographic process.

In a first image transfer, the single color separation impression of the ink image developed on the photoreceptor 112 is transferred from the photoreceptor 112 to an image transfer blanket 124. The image transfer blanket 124 is primarily referred to herein as the print blanket 124 or blanket 124. The print blanket 124 is wrapped around and securely fastened to the outer surface of the intermediate transfer media (ITM) drum 126. The first image transfer that transfers ink from the photoreceptor 112 to the print blanket 124 is driven by electrophoresis of the electrically charged ink particles and an applied mechanical pressure between the imaging drum 114 and the ITM drum 126. The electric field that drives the ink transfer is created by a bias voltage applied to the print blanket 124. Both the blanket bias voltage and the mechanical pressure between the imaging drum 114 and ITM drum 126 can impact the image transfer quality.

The print blanket 124 is heated by both internal and external heating sources such as infrared heating lamps (not shown). The heated print blanket 124 causes most of the carrier liquid and solvents in the transferred ink image to evaporate. The heated blanket 124 also causes the particles in the ink to partially melt and blend together. This results in a finished ink image on the blanket 124 in the form of a hot, nearly dry, tacky plastic ink film. In a second image transfer, this hot ink film image impression is then transferred from the blanket 124 to a substrate such as a sheet of print media 104 (e.g., paper), which is held or supported by an impression (IMP) drum/cylinder 128. Contact pressure between the ITM drum 126 and IMP drum 128 compresses the blanket 124 against the print media 104 to facilitate the transfer of the hot ink film image. The temperature of the print media 104 is below the melting temperature of the ink particles, and as the ITM drum 126 and IMP drum 128 rotate against one another under pressure, the hot ink film comes into contact with the cooler print media 104 and causes the ink film to solidify and peel off from the blanket 124 onto the print media 104.

This process is repeated for each color separation in the image, and the print media 104 remains on the impression drum 128 until all the color separation impressions (e.g., C, M, Y, and K) in the image are transferred to the print media 104. After all the color impressions have been transferred to the sheet of print media 104, the printed media 108 sheet is transported by various rollers 132 from the impression drum 128 to the output mechanism 110.

As mentioned above, during normal printing, an ink image is transferred from the print blanket on the ITM drum to the print media supported on the IMP drum in a second image transfer. The second image transfer is driven by contact pressure between the ITM drum and the IMP drum. However, during a null cycle, normal printing is suspended and the contact pressure between the ITM and IMP drums is not needed because there is no image transfer taking place. In addition, continued contact pressure between the ITM and IMP drums during a null cycle can be especially damaging to the print blanket due in part to the blanket being dry during the null cycle. Thus, as shown collectively in FIGS. 1, 2, and 3, the LEP printing press 100 also includes a drum displacement mechanism 134 and a drum displacement module 208 within print controller 120. As discussed in more detail below, drum displacement mechanism 134 and drum displacement module 208 operate cooperatively to enable the IMP drum 128 to be moved away from the ITM drum 126 during null cycles in order to reduce both the pressure and the area of contact between the drums and between the print blanket 124 and print media 104 supported on the drums. In general, during normal printing, the center-to-center drum distance is compensated for by the thickness of the media to be printed on. During a null cycle, the center-to-center drum distance is selected to be less than the center-to-center thickness of a zero thickness media. This effectively reduces the "nip" during null cycles. However, in order to maintain a stable temperature of the surface of the IMP drum which is important for consistent print quality, the drums do not fully detach from one another.

Figure 2:
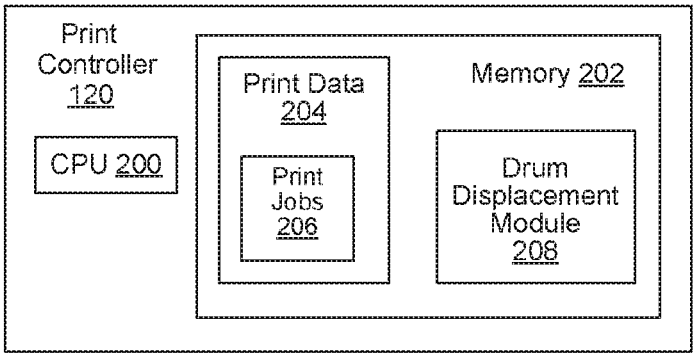
FIG. 2 shows a block diagram of an example print controller suitable for use in an LEP printing press to control a printing process, and to detect the onset of a null cycle and control the contact between a print blanket and an IMP drum during the null cycle.
Figure 3:
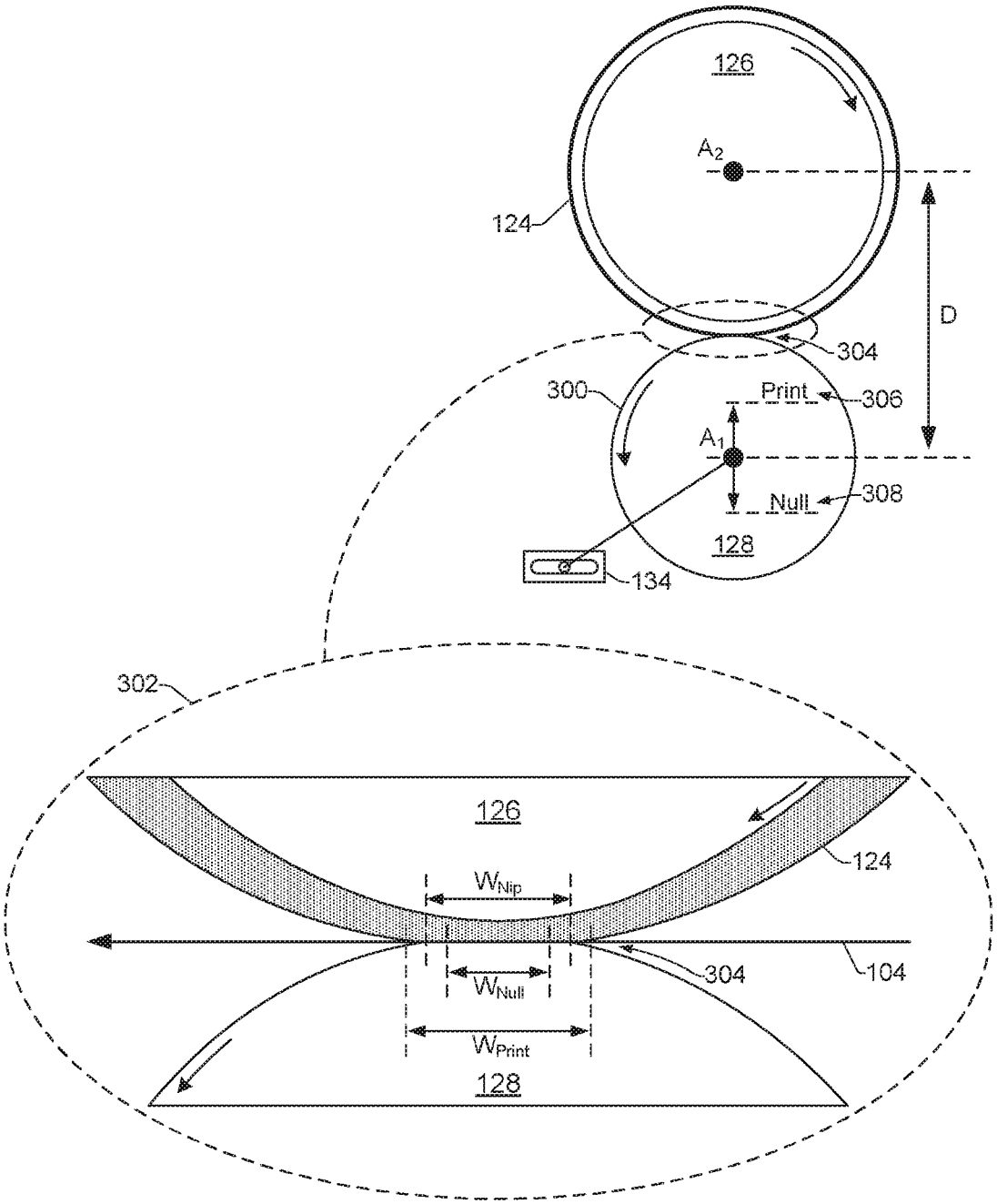
FIG. 3 shows a portion of an image transfer subsystem of an LEP printing press that includes a print blanket wrapped on an ITM drum, an IMP drum in contact with the ITM drum, and a drum displacement mechanism.

FIG. 2 shows a box diagram of an example print controller 120 suitable for an LEP printing press 100 to control a printing process, and to detect the onset of a null cycle and control the contact between a print blanket and an IMP drum 128 during the null cycle. FIG. 3 shows a portion of an image transfer subsystem 300 of an LEP printing press 100 that includes a print blanket 124 wrapped on an ITM drum 126, an IMP drum 128 in contact with the ITM drum 126 through the print blanket 124, and drum displacement mechanism 134.

Referring now generally to FIGS. 1, 2, and 3, print controller 120 comprises a processor (CPU) 200 and a memory 202, and may additionally include firmware and other electronics for communicating with and controlling the other components of print engine 102, the user interface 101, and media input (106) and output (110) mechanisms. Memory 202 can include both volatile (i.e., RAM) and nonvolatile (e.g., ROM, hard disk, optical disc, CD-ROM, magnetic tape, flash memory, etc.) memory components. The components of memory 202 comprise non-transitory, machine-readable (e.g., computer/processor-readable) media that provide for the storage of machine-readable coded program instructions, data structures, program instruction modules, JDF (job definition format), and other data for the printing press 100, such as module 208. The program instructions, data structures, and modules stored in memory 202 may be part of an installation package that can be executed by processor 200 to implement various examples, such as examples discussed herein. Thus, memory 202 may be a portable medium such as a CD, DVD, or flash drive, or a memory maintained by a server from which the installation package can be downloaded and installed. In another example, the program instructions, data structures, and modules stored in memory 202 may be part of an application or applications already installed, in which case memory 202 may include integrated memory such as a hard drive.

As noted above, print controller 120 uses digital image data and other inputs to control the laser imaging unit 118 in the print engine 102 to selectively expose the photoreceptor 112. More specifically, controller 120 receives digital print data 204 from a host system, such as a computer, and stores the data 204 in memory 202. Data 204 represents, for example, documents or image files to be printed. As such, data 204 forms one or more print jobs 206 for printing press 100 that each include print job commands and/or command parameters. Using a print job 206 from data 204, print controller 120 controls components of print engine 102 (e.g., laser imaging unit 118) to form characters, symbols, and/or other graphics or images on print media 104 through a printing process as has been generally described above with reference to FIG. 1.

As previously mentioned, normal printing can be suspended in the press 100 when the print controller 120 receives or detects a null cycle trigger. A null cycle trigger can comprise an interrupt generated by a printing subsystem 136, such as a color calibration subsystem or media transport subsystem. Such subsystem interrupts provide an error indication to the print controller 120 that the subsystem is not ready to continue normal printing. The controller 120 includes drum displacement module 208 which comprises program instructions stored in memory 202 and executable on processor 200 to cause the print controller 120, and/or printing press 100, to receive or detect a subsystem interrupt and to initiate various actions in response to the interrupt. For example, executing instructions from module 208, the controller 120 can use the interrupt as a trigger to insert a null cycle into the printing process and to control the drum displacement mechanism 134 to move the IMP drum 128 away from the ITM drum 126 to help reduce damage to the print blanket 124 during the null cycle.

The drum displacement mechanism 134, also referred to as drum displacer 134, functions to move the IMP drum 128 away from and toward the ITM drum 126 by moving the axis of rotation, A1, of the IMP drum 128 farther from and closer to the axis of rotation, A2, of the ITM drum 126. The result of such movement is to alternately reduce (during null cycles) and increase (during print cycles) the amount of contact and pressure between the print blanket 124 on the ITM drum 126 and the surface 300 of the IMP drum 128. The contact area between the print blanket 124 and the IMP drum surface 300 is often referred to as the "nip" 304. The nip 304 refers to the region between the two drums (126, 128) where the print blanket 124 and the IMP drum surface 300 are in closest proximity to one another, which can be seen more clearly in the cutout portion 302 of FIG. 3.

Referring to the cutout 302 in FIG. 3, both the print blanket 124 and surface 300 of IMP drum 128 can be formed of compressible materials that deform when brought into contact with one another under pressure, such as when the drum displacer 134 moves the axis A1 of the IMP drum 128 closer to the axis A2 of the ITM drum 126. For example, blanket 124 can be formed of a material such as elastic and/or elastic polymers such as acrylic rubber, nitrile rubber and polyurethane. The IMP drum surface 300 may comprise a compliant coating such as a compressible foam material, or impression paper, for example. Accordingly, displacement of the IMP drum 128 away from and toward the ITM drum 126 creates lesser and greater degrees of compression of the blanket 124 and surface 300. Thus the amount of contact between the blanket 124 and IMP drum surface 300 changes, which can be illustrated by the change in the width of the nip 304, $W_{Nip}$.

Under normal printing conditions, print controller 120 controls drum displacer 134 to position the axis A1 of the IMP drum 128 in a print position 306. In the print position 306, the distance D between axis A1 of the IMP drum 128 and axis A2 of ITM drum 126 provides an appropriate pressure between the drums to facilitate the second transfer of the image between the blanket 124 and the print media 104 as the media passes through the nip 304. While the print position 306 is generally described as being maintained at a constant position, in some examples the print position may be adjusted based on fluctuations made to keep the pressure constant during the second image transfer. During printing, increased pressure and contact between the blanket 124 and surface 300 is made apparent by the increased width of the nip 304, illustrated as $W_{Print}$. However, during a null cycle when normal printing is suspended, the print controller 120 (executing module 208 instructions) can advantageously reduce the pressure and contact between the blanket 124 and the print media 104. Therefore, upon receiving an interrupt, print controller 120 can control drum displacer 134 to position the axis A1 of the IMP drum 128 in a null position 308. In the null position 308, the distance D between axis A1 of the IMP drum 128 and axis A2 of ITM drum 126 is increased to reduce the pressure between the drums. During a null cycle, the reduced pressure and contact between the blanket 124 and surface 300 is made apparent by the shortened width of the nip 304, illustrated as $W_{Null}$. It should be noted that the movement shown in FIG. 3 of axis A1 of IMP drum 128 between a print position 306 and a null position 308 has been exaggerated for the purpose of illustration, and is not intended to show an actual amount or degree of movement of the drum 128.

During a null cycle, the controller 120 (e.g., executing instructions from module 208) can continue to insert additional null cycles into the printing process if the controller 120 detects that the subsystem interrupt is ongoing. During the null cycles, the controller 120 can maintain the IMP drum 128 at the null position 308 to continue the reduced pressure between the ITM and IMP drums and the reduced contact between the blanket 124 and drum surface 300 (i.e., reduced the width of nip 304). When the controller 120 detects that the subsystem interrupt has terminated, or is no longer present, the controller 120 can resume the printing process and control the drum displacer 134 to again position the axis A1 of the IMP drum 128 in the print position 306. In some examples, when enough consecutive null cycles are inserted, the controller 120 can eventually cause the press to "time-out" and put the press into a standby mode in which, for example, the drums stop rotating and certain printing subsystems enter an off or "sleep"-like state.

Figure 4:
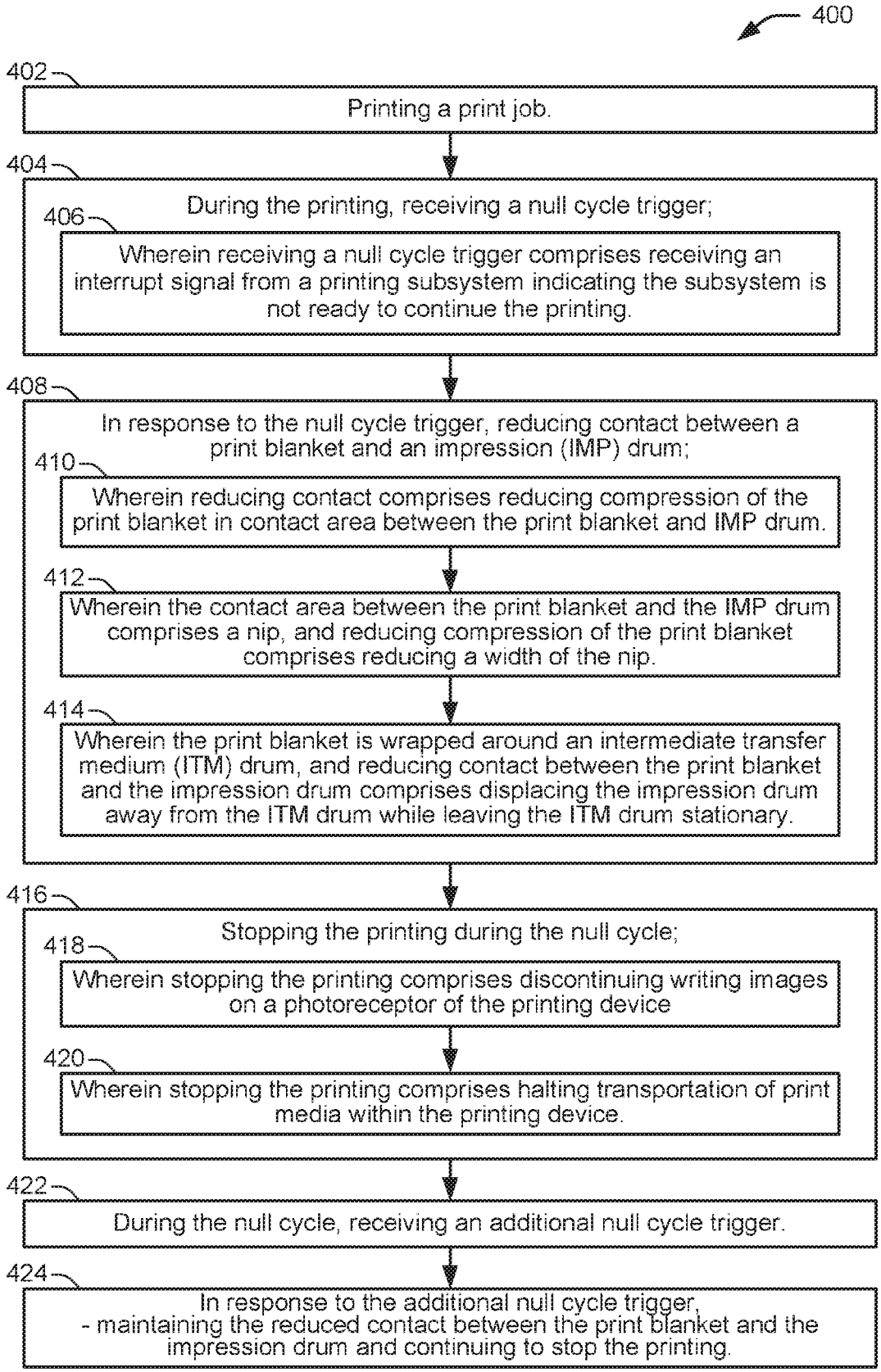
FIGS. 4 and 5 show flowcharts of example methods related to controlling contact between a print blanket and an impression drum within a printing device.
Figure 5:
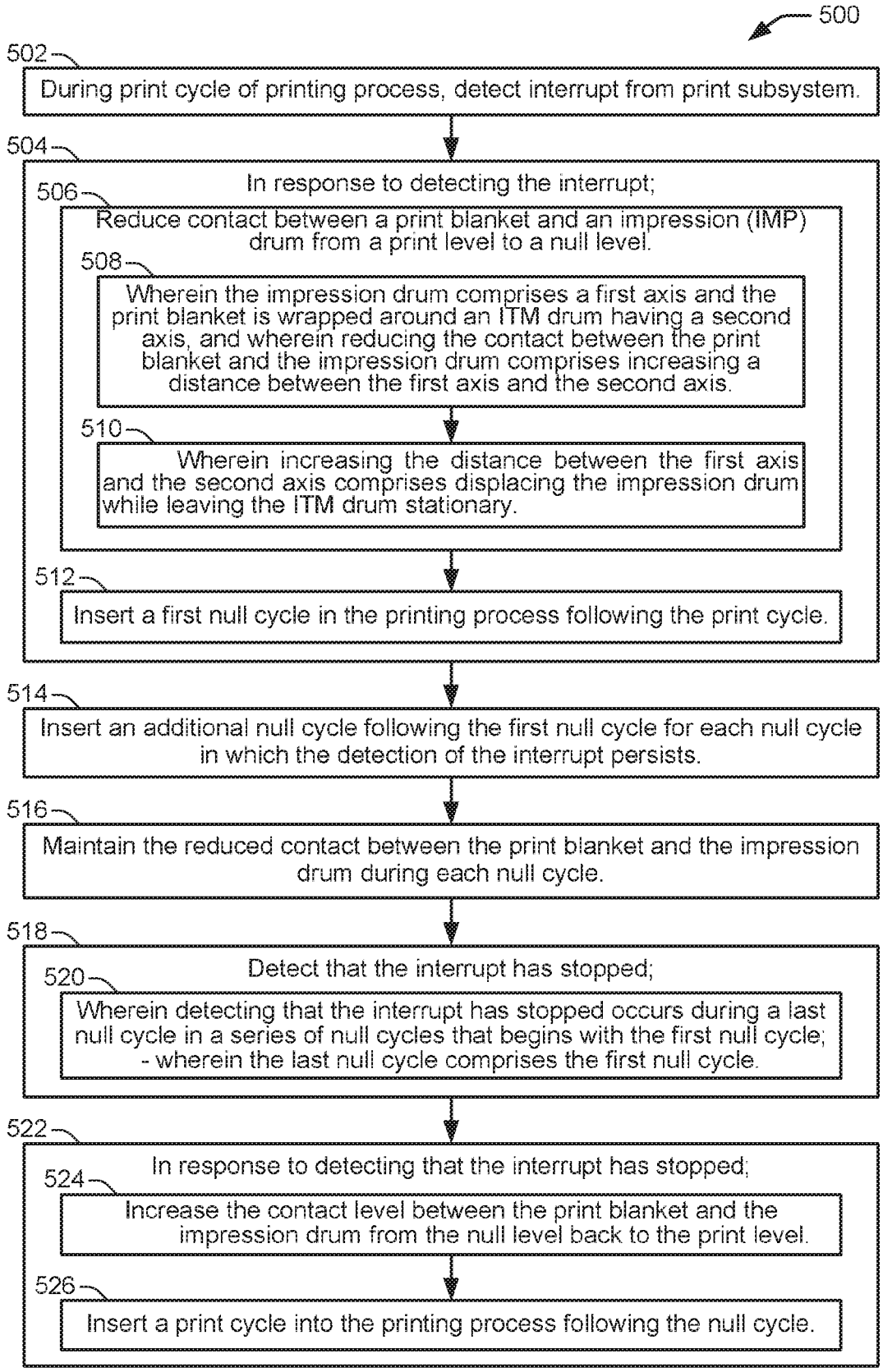

FIGS. 4 and 5 show flow diagrams that illustrate example methods 400 and 500, related to controlling printing in an LEP printing press 100 and to controlling the amount of contact and pressure between a print blanket and an IMP drum 128 during a null cycle. Methods 400 and 500 are associated with the examples discussed above with regard to FIGS. 1-3, and details of the operations shown in methods 400 and 500 can be found in the related discussion of such examples. The operations of methods 400 and 500 may be embodied as programming instructions stored on a non-transitory, machine-readable (e.g., computer/processor-readable) medium, such as memory 202 of printing press 100 as shown in FIGS. 1 and 2. In some examples, implementing the operations of methods 400 and 500 can be achieved by a processor, such as processor 200 of FIG. 2, reading and executing the programming instructions stored in memory 202. In some examples, implementing the operations of methods 400 and 500 can be achieved using an ASIC (application specific integrated circuit) and/or other hardware components alone or in combination with programming instructions executable by processor 200.

Methods 400 and 500 may include more than one implementation, and different implementations of methods 400 and 500 may not employ every operation presented in the respective flow diagrams. Therefore, while the operations of methods 400 and 500 are presented in a particular order within the flow diagrams, the order of their presentation is not intended to be a limitation as to the order in which the operations may actually be implemented, or as to whether all of the operations may be implemented. For example, one implementation of method 400 might be achieved through the performance of a number of initial operations, without performing one or more subsequent operations, while another implementation of method 400 might be achieved through the performance of all of the operations.

Referring now to the flow diagram of FIG. 4, an example method 400 of controlling contact between a print blanket and an impression drum within a printing device such as press 100 begins at block 402, with printing a print job. During the printing, a null cycle trigger is received, as shown at block 404. Receiving a null cycle trigger can include receiving an interrupt signal from a printing subsystem indicating the subsystem is not ready to continue the printing, as shown at block 406. The method 400 continues at block 408 with reducing pressure and contact between a print blanket and an impression (IMP) drum, in response to the null cycle trigger. Reducing contact between a print blanket and IMP drum can include reducing compression of the print blanket in a contact area between the print blanket and IMP drum, as shown at block 410. As shown at block 412, the contact area between the print blanket and the IMP drum comprises a nip, and reducing compression of the print blanket comprises reducing the width of the nip. As shown at block 414, the print blanket can be wrapped around an intermediate transfer medium (ITM) drum, and reducing contact between the print blanket and the impression drum can include displacing the impression drum away from the ITM drum while leaving the ITM drum stationary. The method 400 also includes stopping the printing during the null cycle, as shown at block 416. Stopping the printing may comprise discontinuing writing images on a photoreceptor of the printing device and halting transportation of print media within the printing device, as shown at blocks 418 and 420, respectively. Method 400 continues with receiving an additional null cycle trigger during the null cycle, and in response to the additional null cycle trigger, maintaining the reduced contact between the print blanket and the impression drum and continuing to stop the printing, as shown at blocks 422 and 424, respectively.

Referring now to the flow diagram of FIG. 5, an example method 500 related to controlling contact between a print blanket and an impression drum within a printing device such as press 100 begins at block 502, with detecting an interrupt from a printing subsystem during a print cycle of a printing process. In response to the interrupt (block 504), contact between a print blanket and an impression (IMP) drum is reduced from a print level to a null level, as shown at block 506. Where the impression drum includes a first axis and the print blanket is wrapped around an ITM drum that has a second axis, reducing the contact between the print blanket and the impression drum can include increasing a distance between the first axis and the second axis, as shown at block 508. As shown at block 510, increasing the distance between the first axis and the second axis can include displacing the impression drum while leaving the ITM drum stationary. Further in response to the interrupt, at block 512, a first null cycle can be inserted into the printing process following the print cycle. As shown at block 514 of method 500, for each null cycle in which the detection of the interrupt persists, an additional null cycle can be inserted following the first null cycle. Furthermore, as shown at block 516, during each null cycle, the reduced contact between the print blanket and the impression drum can be maintained during each null cycle. Method 500 can continue as shown at block 518, with detecting that the interrupt has stopped. As shown at block 520, detecting that the interrupt has stopped can occur during a last null cycle in a series of null cycles that begins with the first null cycle. In some examples, the last null cycle comprises the first null cycle. In response to detecting that the interrupt has stopped (block 522), the contact level between the print blanket and the impression drum can be increased from the null level back to the print level, as shown at block 524. Further in response to detecting that the interrupt has stopped, as shown at block 526, a print cycle can be inserted into the printing process following the null cycle in order to begin normal printing from the press.

What is claimed is:

1. A method, comprising:

printing a print job;

during the printing, receiving an interrupt to trigger a null cycle during the printing;

in response to the receiving the interrupt, repositioning an impression drum to a null position to reduce contact between a print blanket and the impression drum; and in response to detecting that the interrupt has stopped, changing a positioning of the impression drum from the null position back to a print position.

2. The method of claim 1, wherein the repositioning the impression drum to the null position comprises reducing compression of the print blanket in a contact area between the print blanket and the impression drum.

3. The method of claim 2, wherein the contact area between the print blanket and the impression drum comprises a nip, and the reducing compression of the print blanket comprises reducing a width of the nip.

4. The method of claim 1, wherein the print blanket is wrapped around an intermediate transfer medium (ITM) drum, and the repositioning the impression drum to the null position comprises:

displacing the impression drum away from the ITM drum while leaving the ITM drum stationary.

5. The method of claim 1, further comprising suspending writing and development of images to a photoreceptor and halting transportation of print media to the impression drum during the null cycle.

6. The method of claim 5, further comprising:

during the null cycle, receiving a trigger of an additional null cycle;

in response to the receiving the trigger of the additional null cycle, maintaining a null width level contact between the print blanket and the impression drum; and continuing the suspending of the writing and development of the images to the photoreceptor and the halting of the transportation of the print media to the impression drum.

7. The method of claim 1, wherein the receiving the interrupt comprises receiving an interrupt signal from a printing subsystem indicating the printing subsystem is not ready to continue the printing of the print job.

8. The method of claim 1, further comprising:

receiving an ink image by the print blanket from a photoreceptor in a first transfer; and transferring the ink image onto print media supported on the impression drum in a second transfer.

9. The method of claim 1, further comprising positioning the impression drum to create a print width nip level contact between the print blanket and the impression drum.

10. The method of claim 1, wherein the repositioning the impression drum to the null position comprises reducing contact between the print blanket and the impression drum from a print width nip level contact to a null width level contact.

11. A printing device comprising:

a print blanket to transfer an ink image from a photoreceptor onto print media on an impression (IMP) drum during printing;

a drum displacer to displace the IMP drum; and a controller to:

during the printing, detect an interrupt for a print job being printed by the printing device;

responsive to the interrupt, cause the drum displacer to displace the IMP drum from having a print width nip level contact with the print blanket to having a null width level contact with the print blanket;

detect that the interrupt has stopped;

adjust the IMP drum back to having the print width nip level contact with the print blanket; and insert a print cycle into the print job.

12. The printing device of claim 11, further comprising a printing subsystem selected from a media transport subsystem and a color calibration subsystem, wherein the printing subsystem is to generate the interrupt when the printing subsystem senses it is not ready to perform a print cycle.

13. A non-transitory machine-readable storage medium storing instructions that when executed by a processor, cause the processor to:

during a print cycle of a printing process detect an interrupt from a printing subsystem; and in response to detecting the interrupt, insert a first null cycle into the printing process following the print cycle;

insert an additional null cycle following the first null cycle for each null cycle in which the detecting of the interrupt persists; and maintain a reduced contact level at a null level between a print blanket and an impression drum during each null cycle.

14. The non-transitory machine-readable storage medium of claim 13, the instructions further causing the processor to:

detect that the interrupt has stopped;

in response to detecting that the interrupt has stopped, position the impression drum from the null level to a print level to provide an increased contact level between the print blanket and the impression drum; and insert a print cycle into the printing process following the first null cycle.

15. The non-transitory machine-readable storage medium of claim 14, wherein detecting that the interrupt has stopped occurs during a last null cycle in a series of null cycles that begins with the first null cycle.

16. The non-transitory machine-readable storage medium of claim 15, wherein the last null cycle comprises the first null cycle.

17. The non-transitory machine-readable storage medium of claim 13, wherein the impression drum comprises a first axis and the print blanket is wrapped around an intermediate transfer medium (ITM) drum having a second axis, and wherein to reduce the contact between the print blanket and the impression drum, the instructions further cause the processor to increase a distance between the first axis and the second axis.

18. The printing device of claim 11, wherein the IMP drum comprises a first axis and the print blanket is wrapped around an intermediate transfer medium (ITM) drum having a second axis.

19. The printing device of claim 11, wherein the interrupt stops during a last null cycle in a series of null cycles that begins with a first null cycle.

20. The non-transitory machine-readable storage medium of claim 13, wherein the interrupt is generated when the printing subsystem senses it is not ready to perform the print cycle.

* * * * *